US008158875B2

(12) United States Patent
Stanger Ramirez

(10) Patent No.: US 8,158,875 B2
(45) Date of Patent: Apr. 17, 2012

(54) ERGONOMETRIC ELECTRONIC MUSICAL DEVICE FOR DIGITALLY MANAGING REAL-TIME MUSICAL INTERPRETATION

(76) Inventor: Rodrigo Stanger Ramirez, Santiago (CL)

( * ) Notice: Subject to any disclaimer, the term of this patent is extended or adjusted under 35 U.S.C. 154(b) by 0 days.

(21) Appl. No.: 12/712,061

(22) Filed: Feb. 24, 2010

(65) Prior Publication Data

US 2011/0203445 A1 Aug. 25, 2011

(51) Int. Cl.
*G10H 7/00* (2006.01)

(52) U.S. Cl. ..... 84/645; 84/638; 84/744

(58) Field of Classification Search ..... 84/645, 84/638, 716, 718, 719, 743, 744
See application file for complete search history.

(56) References Cited

U.S. PATENT DOCUMENTS

| | | | | |
|---|---|---|---|---|
| 3,725,562 | A | 4/1973 | Munch, Jr. et al. | |
| 3,842,182 | A | 10/1974 | Bunger | |
| 4,137,809 | A | 2/1979 | Bunger | |
| 4,279,187 | A | 7/1981 | Kappes | |
| 4,616,547 | A | 10/1986 | Mancini et al. | |
| 5,841,052 | A * | 11/1998 | Stanton | 84/600 |
| 5,883,325 | A * | 3/1999 | Peirce | 84/615 |
| 6,031,174 | A * | 2/2000 | Takabayashi | 84/609 |
| 6,229,082 | B1 * | 5/2001 | Masias | 84/645 |
| 7,692,090 | B2 * | 4/2010 | Negoescu et al. | 84/718 |
| 7,754,955 | B2 * | 7/2010 | Egan | 84/600 |
| 2009/0114079 | A1 * | 5/2009 | Egan | 84/477 R |
| 2010/0307321 | A1 * | 12/2010 | Mann et al. | 84/613 |

FOREIGN PATENT DOCUMENTS

| | | |
|---|---|---|
| EP | 0978117 | 9/2000 |

* cited by examiner

*Primary Examiner* — Jeffrey Donels
(74) *Attorney, Agent, or Firm* — Karim Lagobi

(57) ABSTRACT

The invention provides an electronic musical device for performing music and/or managing music interpretation through modification of rhythm, tone and timbre, in real time and by setting music attributes using MIDI data. The electronic device has an input interface unit for enabling a user to input music data. The input module comprises an ergonometric console with an assortment of press buttons, each of which is assigned at least one musical function. A musical function is triggered by pressing a button, which performs a tonal sequence in the form of melodies and/or arpeggios. The electronic music device provides allows a user to interact with the music data, by entering music input and/or settings data through a touch screen, control the output of a music data stream, use existing music scale, generate new scales or derive scale from the existing scales, and store and retrieve the data as needed.

16 Claims, 3 Drawing Sheets

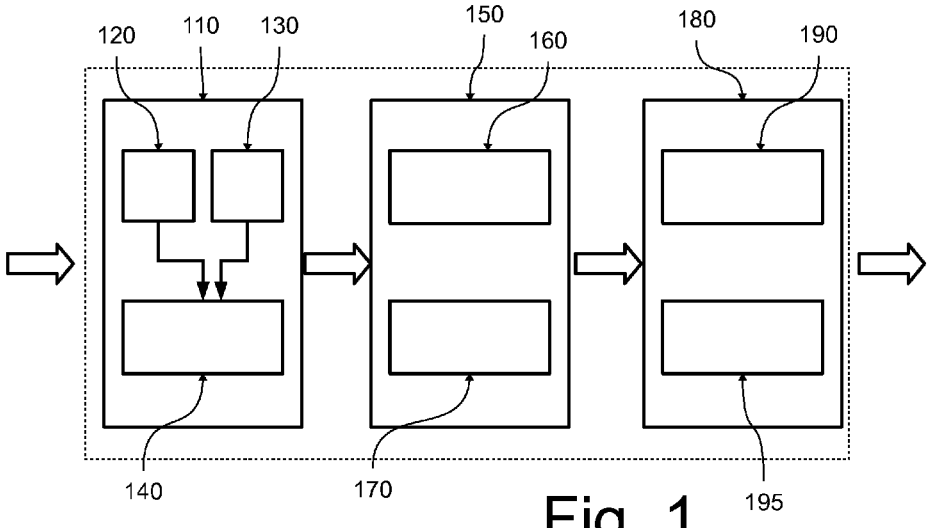
Fig. 1
Fig. 2
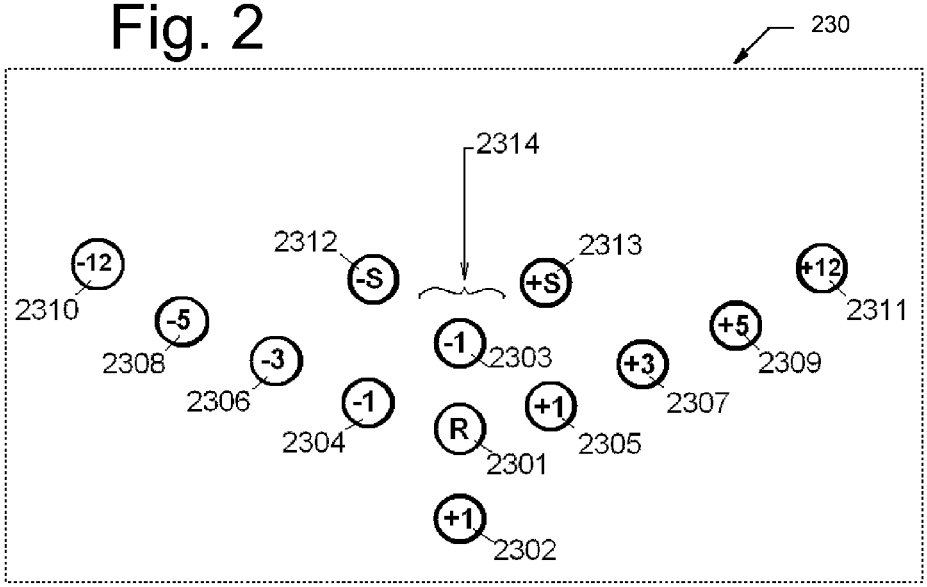

ERGONOMETRIC ELECTRONIC MUSICAL DEVICE FOR DIGITALLY MANAGING REAL-TIME MUSICAL INTERPRETATION

FIELD OF THE INVENTION

The invention relates to an electronic music device for digitally managing real-time music interpretation through data setting using midi protocol, more specifically, the invention provides an ergonometric electronic and portable musical interface for music interpretation of arpeggios and melodic motifs using input data through musical instrument digital interface (MIDI) protocol.

BACKGROUND OF THE INVENTION

Each music instrument posses its individual characteristics, not only in term of sound quality, but also in terms of the skill set a music performer has to acquire in order to play the instrument. Thus, the interface of harpsichords, pianos, keyboards, and synthesizers, or the interface of wind and string instruments require different skill sets for playing a given instrument. Electronic media have opened a vast field of possibilities for creating and performing music. With relative ease, they allow a composer and/or performer to create new sounds and/or alter recorded music in a variety of ways.

However, music instruments have remained unmodified for centuries, and their designs have been maintained and integrated into the new music instruments that incorporate electronic and digital technologies. For example, synthesizers inherit the same performance interface as the piano and its forerunners, such as the harpsichord. Variations or breakthrough areas have been focused on timbristic generation sources and not on the interpretation manner or the way the user produces music with the electronic device.

Furthermore, certain performance techniques require even more time consuming practice in order to be mastered. The latter is evident with playing arpeggios. Playing arpeggio consists of playing the tones of a chord in sequence, rather than simultaneously.

The invention of the present disclosure may be a member of an even more specific instrument family, such as the musical electronic systems and/or devices known as Arpeggiators (a.k.a. "arp").

Munch Jr et al. in U.S. Pat. No. 3,725,562, titled "Arpeggio system for electronic Organ", Bunger U.S. Pat. No. 3,842,182, titled "Arpeggio System", and U.S. Pat. No. 4,137,809, titled "Arpeggio system for electronic organs", make reference to method of an electronic nature aimed at intervening in the sound output processes searching the automatic arpeggio performance for each chord tone played (preferably in octaves, i.e., creating tonal intervals, 12 half steps above or below the chord tone played). The implementation of such methods aims towards its integration in musical devices such as electronic organs.

Under the same logic as Bunger, Kappes in U.S. Pat. No. 4,279,187, titled "Digital arpeggio system for electronic musical instrument", describes the automatic generation of chord tones in upper octaves which corresponds to the manual performance of the user or interpreter.

Gannon in European patent (No. EP 0978117), titled "Automatic improvisation system and method", describes the improvisation captures carried out by the professional musicians which are integrated into a MIDI device, and then, in accordance with the rules of the system, are usually integrated in a deferred manner as a contribution to the creative process of the user.

Mancini and Huber, in U.S. Pat. No. 4,616,547, Oct. 14, 1986, titled "Improviser circuit and technique for electronic musical instrument", describe a circuit that executes automatic improvisations generated through the use of randomly generated musical variations of rhythmical and tonal nature.

As its common axis, all the above references share the development of methods and systems for performing arpeggios. As a rule, the focus is put on octaves arpeggios and always applying automatic procedures. In other words, the interpretation of the music by the user is not relevant to the generation of these music sequences: the inventions themselves produce the arpeggios.

As a consequence of the aforementioned, the state of the art given in the above references, the generation of Arpeggios is provided automatically in a black box without the creative participation of the user, without participation of the user in the performance, in other words, the user is a mere spectator of those processes.

The current invention, however, offers an ergonometric, digital and portable musical device which includes a Central Processing Unit (CPU) plus a firmware so as to provide both well-known and originals scale coding, and a procedure for free interpreting concerning progression, chord tones replication, harmony, and rhythm through the use of a MIDI protocol.

SUMMARY OF THE INVENTION

The present invention provides an ergonometric, electronic, and portable musical device which allows to digitally perform and manage musical interpretation in its tone, rhythm, and timbre phases and which includes an input unit, a processing and storage unit, and an output unit.

The input unit is comprised of a physical module for musical performance of a tempered tonal character; a physical module for timbristic musical management; and a virtual module for tonal and timbristic control, as well as musical performance settings, provided with a data input source which is operated through a touch screen and a console having several operation media which enables data input.

The processing and storage unit is comprised of a algorithmic management module (e.g., a computer program) that provides a method for coding and arranging all the musical scales derived from or included in the Tempered Scale (musical scale composed by 12 half steps). The algorithmic management module also provides coding of scale. Such a coding method offers the users of the invention herein a procedure for creative musical performance or interpretation, in a real-time, of musical phrases and motifs, and, more particularly, of arpeggios and melodies. Thus the user may interpret or vamp over any musical scale arranged by the coding method.

The invention enables a user to establish a method for creating and/or editing musical scales including tempered scales and any musical scale derived therefrom.

The algorithmic processing functions are determined by the actions the user or interpreter perform at the input unit level, which brings him/her the opportunity to access to a melodic or arpeggiate performance or interpretation of, for instance, major, minor, augmented, and diminished scales, and of all those scales the user may produce at free will and interest. The method provided allows the user or interpreter to perform melodic and/or arpeggiate interpretations of an ascendant, descendant, and/or mixed nature, including the tonal replication for the last interval performed and pertaining to the scale under performance.

In addition, the processing and storage unit includes a storing module which allows to store—and retrieve for its use—the scales the user needs for his/her musical performances. The storage media may be of an internal or external nature. This storing module has—in its initial setting—at least 33 scales available to the user or interpreter which are recurring during musical interpretation.

The output unit includes both a MIDI module and a graphical user interface module which allows the visualization of output data.

The ergonometric musical device, which through a digital management allows tonal and timbristic musical interpretation, propose to surpass the benefits and purposefulness qualities the other well-known musical performance interfaces offer and which belongs to the prior art.

The ergonometric musical device of the invention allows the users to musically perform—as a soloist or in synchrony with other instruments—musical pieces which leave room for melodic and/or arpeggiate vamp with no chances for musically untuning.

DESCRIPTION OF THE DRAWINGS

FIG. 1 is a block diagram representing modules of an electronic music device in accordance with an embodiment of the invention.

FIG. 2 is a graphical representation of an input interface having a plurality of press buttons in accordance with an embodiment of the invention.

DETAILED DESCRIPTION OF THE INVENTION

Figure 3:
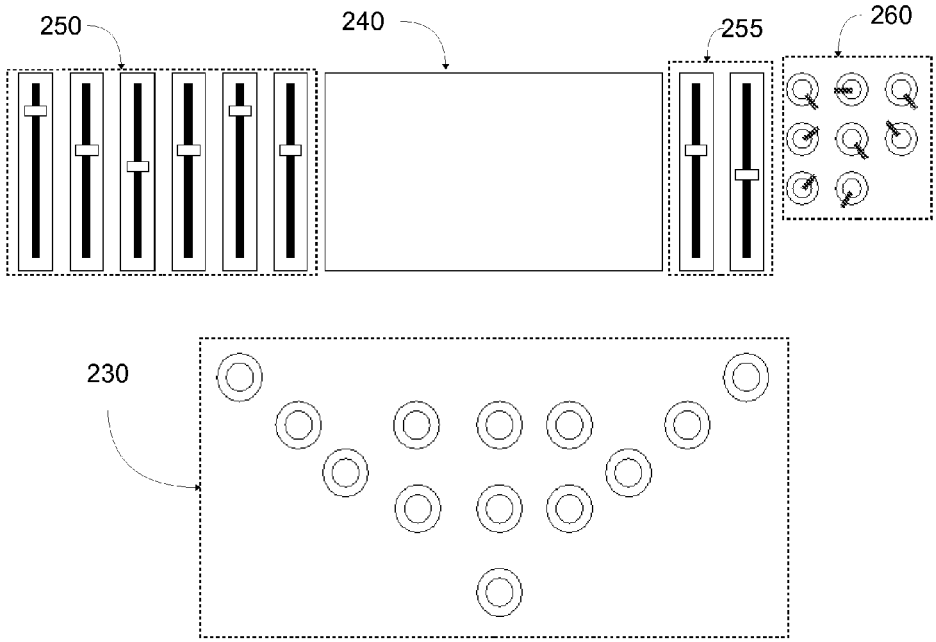
FIG. 3 shows a schematic representation of the layout of the physical components of the user interface of a preferred embodiment of the invention.

The invention provides an electronic music device for digitally managing music interpretation in its rhythmic, tonal and timbristic attributes, allowing both real time performance and the setting of music data by a user in an environment of digital management provided by the MIDI protocol.

FIG. 1 is a block diagram representing modules of an electronic music device in accordance with an embodiment of the invention. An embodiment of the invention is an electronic music system having an input unit 110 equipped with a physical module for tonal musical performance 120 with an ergonometric console having an assortment of press buttons 230, wherein each button is assigned a musical function to perform one or more tonal sequences in the form of melodies and/or arpeggios; a virtual module for tonal, timbristic and custom musical performance 130 with a touch screen 240; a physical module for timbristic musical management and performance 140 providing dynamic controls 250, 255 and 260 to actuate a MIDI protocol data stream; a processing and storage unit 150 comprised of an algorithmic management module 160 to code and perform the sequences of tonal intervals or scales over the tempered scale and by a storage media 170, which allows a user to discretionally store and retrieve the scales as needed for performances; and an output unit 180 with a MIDI module 190, which enables the musicalization functions provided by such a protocol, a visual information module 195 having a graphical user interface, preferably the touch screen 240 of the virtual module for tonal, timbristic and custom musical performance 130 as a first choice, which also makes it possible to provide a visual feedback to the user/performer.

The input module 110 is comprised of a physical module for tonal musical performance 120; a virtual module for tonal, timbristic and custom music performance 130; and a physical module for timbristic musical managing and performance 140. The physical module for tonal musical performance 120 has an ergonometric console 230 with an assortment of press buttons through which data is entered by the user or interpreter. The virtual module for tonal, timbristic and custom music performance 130 has, preferably, a touch screen 240 where the arrangement of the press buttons of the console 230 is shown in FIG. 2. Furthermore, this virtual module for tonal, timbristic and custom music performance 130 offers the user a variable number of press buttons, which may be set in accordance with customized arrangements different from those offered by default by the physical console for tonal musical performance 120, and through which the user or interpreter enters data regarding the timbristic musical control parameters and other configurable setting parameters. In addition, the input unit 110 has a physical module for timbristic musical managing and performance 140 characterized by its dynamic controls to actuate on musical functions such as timbre, color, and tessitura, or any other musical attribute, accomplished by various linear variable resistances, of sliding potentiometer-type, preferably motor-driven 250 and 255 along with various linear variable resistances, of rotary potentiometer-type 260, also preferably motor-driven.

The arrangement of the sliding and rotary potentiometers of the timbristic musical management and performance module 140 permits the user or interpreter to manage, in a real time basis, all of the hundred and twenty eight (128) control functions supported by MIDI protocol. As an example, it is possible to manually control management, edition, and variation of the tone, speed, volume and expression functions, among others, all of them included in the MIDI output Module 190.

The processing and storage module 150 is comprised of an algorithmic management module 160 over the tempered musical scale and by a storage media 170, which allows a user to discretionally store and retrieve the scales needed for musical performances. The processing and storage module 150 also makes it possible to store and retrieve new settings for each one of the detailed modules in the invention herein.

The output unit 180 includes a MIDI module 190 and a visual information module 195 which makes it possible to visualize output data through a graphical user interface which, in this case, is the same touch screen 240 of the input module 110.

FIG. 2 is a graphical representation of an input interface having a plurality of press buttons in accordance with an embodiment of the invention. The ergonometric nature of this interface is intended to maximize the relationship between user and musical instrument trying both to reduce the physical effort or load and to maximize the development process of psychomotor skills required for musical performance.

The input unit 110 is presented as an interface of maximum simplicity for an intuitive understanding attained by trial and error learning with a console, either physical or virtual, for example, by means of a touch screen that displays a press button arrangement corresponding to the most natural position of the hands while resting on a flat surface.

In a preferred embodiment, as it is shown on FIG. 2, such console 230 may have between three (3) to twenty one (21) press buttons, preferably, thirteen (13) press buttons, ergonometrically arranged to allow the hands to rest in a relaxed position when a hand is pressing one or more buttons at the same time, thus preventing contractures due to otherwise anti-natural positions. As a result, press button arrangement starts with a central column 2314 displaying three press buttons, one central/middle press button 2313, and one press button at each end: top 2303, and bottom 2302. In such an arrangement one of the press buttons located at one end forms an external horizontal row with other two press buttons, thus forming a left press button 2312 and a right press button 2313. Furthermore, from the central press button 2301 starts a horizontal row (i.e, generally perpendicular to the central row) which may be a straight row or an ascendant straight row, consequently creating a left horizontal row and a right horizontal row. The left horizontal row may be formed by three press buttons 2304, 2306, and 2308 or by four press buttons 2304, 2306, 2308, and 2310 all known as "left press buttons" while the right horizontal row may be formed by three press buttons 2305, 2307, and 2309 or by four press buttons 2305, 2307, 2309 and 2311 known as a whole as "right press buttons".

Each press button has an assigned musical function that is triggered when the button is pressed. The press button located at one end 2302 of the central column 2314 and the first right press button 2305 located immediately next to the central press button 2301 have a +1 meaning that in the course if playing a chord tone, pressing either buttons will result in playing the chord tone corresponding to the next interval of the chord tone. For instance, in the case the scale established by the processing and storage module corresponds to C Major Scale (C-D-E-F-G-A-B) and the last chord tone played corresponds to its fifth interval (G), thus pressing 2302 or 2305 (i.e. having value of "+1"), the next tonal interval that shall be played is the A chord note.

Likewise, the press button located at the other end 2303 of the central column and the first left press button 2304 located immediately next to the central press button 2301 have a "−1" value assigned allowing to play the chord tone corresponding to the previous interval in the course of playing a chord tone. For example, if the scale established by the processing and storage module corresponds to C Major Scale (C-D-E-F-G-A-B) and the last chord tone played corresponds to its fifth interval (G), thus pressing the press button 2303 or 2304 would result in playing the previous tonal interval, that is, the F chord note.

The functions of the press buttons which have been assigned with the "+1" value [2302, 2305] and "−1" value [2303, 2304] are of a relative nature and will always be related to the last chord tone or interval played.

Similarly, the second right press button 2307, arranged immediately next to the first right press button 2305, receives a "+3" value which allows playing the chord tone corresponding to the third interval of the tonic or root chord tone of the musical scale selected and in its corresponding octave. For example, assuming a melodic interpretation in C Major Scale, fourth octave, and regardless of the last chord tone played, pressing the second right press button 2307 of "+3" value, the third tonal interval of the declared tonic, that is $E_{(4)}$ shall be played.

The third right press button 2309 receives a "+5" value which allows to play the chord tone corresponding to the fifth interval of the tonic or root chord tone of the musical scale selected and in its corresponding octave, regardless of the last chord tone played.

The fourth right press button 2311 has a "+12" value assigned allowing to play the chord tone in an upper octave position (12 half steps) regarding the tonic or root chord tone of the selected Musical Scale, depending on the octave in which it is played. For instance, given the tonic of a C major scale, $3^{rd}$ octave, pressing the "+12" value press button the C chord note, fourth octave or C $(_4)$, shall be played.

Musical functions associated with press buttons having assigned values of "+3", "+5" and "+12", compute the corresponding tone based on the root or tonic chord tone of a selected scale and the octave currently played.

In a similar way, the left press buttons, namely the second left press button 2306, the third left press button 2308, and the fourth left press button 2310, have the "−3", "−5", and "−12" values assigned respectively, and shall perform the same operation as the press buttons with a "+" value assigned, in other words, third and fifth declared interval within the previous octave.

The functions assigned to the left and right press buttons from the second to the fourth with the "3", "5", and "12" values assigned, regardless of the symbol ("+" or "−") accompanying them, are of an absolute nature and deal with the tonic or root chord tone of the Scale and its respective octave in which the tonal function of the instrument is set.

The left press button 2312 has a "−S" nomenclature and the right press button 2313 a "+S" nomenclature, respectively, and are respectively assigned musical functions that move through a sequence of chord tones of the scale without playing the tones tonally, that is to say, allowing to silently ascend or descend through the tonal intervals of the scale, having a different relative tonal available for the "+1" 2305, "−1" 2304, and central press buttons' 2301 nomenclatures.

For instance, if the user or interpreter is performing in the C Major Scale and the last musical interval played was the third one, that is E, the user has the "+S" key available pressing it twice. Consequently, pressing the central press button 2301, G chord tone is played. In a similar way, if the press button used has a "+1" nomenclature, the chord tone timbristically played shall be A.

Finally, the central press button 2301 having the "R" nomenclature, is intended to repeat the last chord tone played or, to timbristically perform the new interval resulting from the operation of the press buttons with the "+S" and "−S" 2312, 2313 nomenclatures.

Regarding the benefits resulting from the virtual state of the art, that is, the emulated interaction in a digital environment of processes with a physical or hard correlate, the interface at hand has a module for tonal, timbristic and custom music performance 130 available, specially of MIDI setting and of firmware in general, by means of which the user or interpreter shall be able to use all the functions included within the processing and storing unit 150, meaning the user or interpreter is able to choose, for instance, the number of press buttons, the shifts of absolute and relative tonal intervals, and their spatial distribution, determine their individual size and customize the settings for the firmware in general.

The physical module for timbristic musical managing and performance 140 allows for changing, in real-time, the quality and sound features of the tones or chord tones played either on an individual or arpeggiated basis, establishing the manual control over modification and/or timbristic enhancement factors such as speed, echo, tonal variation, synthesis parameters, etc. Using the dynamic controls—sliding potentiometer type control 250 and 255 and rotary potentiometer type control 260—the actions for changing these parameters are manually entered by the user.

Meanwhile, the module for timbristic musical management and performance 140 along with the virtual module for tonal, timbristic and custom music performance 130 allow the user to set the settings of each module or subsystem of the present invention including control over the firmware.

The approach to data input is achieved through the input unit 110 which converges in the processing and storing unit 150. Unit 150 is formed by an algorithmic management module over the tempered musical scale 160 which includes an algorithm and a method to code all the musical scales contained in and/or derived from it, as well as a procedure to play music in a creative manner, getting scales codified—by this method—available to the user or interpreter to play many melodic and/or arpeggial patterns, specifically known as vamps or improvisations.

The tempered scale is a musical scale of twelve chord tones, or half steps, characterized by the fact that the ratio between tones or frequencies of the intervals or chord tones of the scale is determined by a geometric progression as follows:

given "f" a tone of the tempered musical scale; and given "y" the geometric progression detailed below:

$$y=f, f\cdot r, f\cdot r^2, f\cdot r^3, f\cdot r^4, \ldots f\cdot r^{12}=2\cdot f$$

Hence:

$$r^{12}=2,$$

where $$r=\sqrt[12]{2}=1.059\ldots$$

Thus the distance, or ratio, between intervals (in its tone/frequency ideation) is 1.059. As a result, a stable tune is achieved being it ideal for instruments with fixed intervals, assumed tune-up and, integrated to MIDI protocol as well as for the instruments which derive from it.

The nomenclature assigned to each chord tone of this scale is as follows: C, C♯ or D♭, D, D♯, E, F, F♯ or G♭, G, G♯ or A♭, A, A♯ or B♭, and B.

The processing and storing unit 150 permits to control the MIDI Output module, using the same protocol the module itself uses, for the tonal musical management. Such protocol gives a numeric value to link each chord tone of the Tempered Scale to a value ranging from 0 to 127.

Table 1 shows MIDI values per chord tone or half step versus octave for each chord tone in relation to its octave.

TABLE 1

| | Octave | | | | | | | | | | |
|---|---|---|---|---|---|---|---|---|---|---|---|
| Chord Tone | 0 | 1 | 2 | 3 | 4 | 5 | 6 | 7 | 8 | 9 | 10 |
| C | 0 | 12 | 24 | 36 | 48 | 60 | 72 | 84 | 96 | 108 | 120 |
| C# | 1 | 13 | 25 | 37 | 49 | 61 | 73 | 85 | 97 | 109 | 121 |
| D | 2 | 14 | 26 | 38 | 50 | 62 | 74 | 86 | 98 | 110 | 122 |
| D# | 3 | 15 | 27 | 39 | 51 | 63 | 75 | 87 | 99 | 111 | 123 |
| E | 4 | 16 | 28 | 40 | 52 | 64 | 76 | 88 | 100 | 112 | 124 |
| F | 5 | 17 | 29 | 41 | 53 | 65 | 77 | 89 | 101 | 113 | 125 |
| F# | 6 | 18 | 30 | 42 | 54 | 66 | 78 | 90 | 102 | 114 | 126 |
| G | 7 | 19 | 31 | 43 | 55 | 67 | 79 | 91 | 103 | 115 | 127 |
| G# | 8 | 20 | 32 | 44 | 56 | 68 | 80 | 92 | 104 | 116 | |
| A | 9 | 21 | 33 | 45 | 57 | 69 | 81 | 93 | 105 | 117 | |
| A# | 10 | 22 | 34 | 46 | 58 | 70 | 82 | 94 | 106 | 118 | |
| B | 11 | 23 | 35 | 47 | 59 | 71 | 83 | 95 | 107 | 119 | |

The algorithmic management module 160 offers a relationship integrating the coding of all the possible musical scales (derived from and/or contained in the tempered scale, including the latter). The definition of this relationship is as follows:

let be "T" the set of musical chord tones of the Tempered Scale defined by:

$$T=\{(n_i)_o | i\in\{0, 1, \ldots 11\}\} o\in N$$

Where "o" is the musical octave, it is possible to name each $n_i$ by a single name:

$$n_o=C,\ n_1=C\sharp, \ldots, n_{11}=B$$

Then, for example, $(n_2)_3=(D)_3$, corresponding to D chord tone in the third octave.

Now, any scale is defined as:

$$E_x=(I,n_s)=\{fs(s+i,o) | i\in I, I\subset\{0, 1 \ldots 11\}\} o\in N$$

Where $n_s$ is the index for the tonic or root chord tone of the scale, I determines the chord tones of the basic tempered scale, including this scale itself, and fs represents the function of scale jumping defined by:

$$fs(x,o)=(n_{x\ mod\ 12})_{o+x\ div\ 12}$$

Where mod is the operator resulting from the even division operation and div is the even division operation. Basically, this function brings the possibility to shift to the next scale whenever the index of a chord tone surpasses the range of the on going scale (if the index of the chord tone is >11, it shifts to the next octave).

Then, for instance, $$fs(14,1)=(n_{14\ mod\ 12})_{1+14\ div\ 12}=(n_2)_2=(C\sharp)_2$$

It should be noted that, in accordance with this definition, a scale corresponds to randomly selected chord tones, defined by a set of indexes, from 0 to 11 (I) and by a root chord tone ($n_s$).

For example, consider the F Major Scale defined as follows:

$$F\ Major\ scale=(I,n_s)=(\{0,2,4,5,7,9,11\},F)=(\{0,2,4,5,7,9,11\}, n_5)$$

$$F\ Major\ scale=\{fs(5+i,o)/i\in\{0,2,4,5,7,9,11,\},\} o\in N$$

$$F\ Major\ scale=\{fs(5,0), fs(7,0), fs(9,0), fs(10,0), fs(12,0) \ldots\}$$

$$F\ Major\ scale=\{(n_5)_0, (n_7)_0, (n_9)_0, (n_{10})_0, (n_{10})_0 \ldots\}$$

$$F\ Major\ scale=\{F_0, G_0, A_0, Bb_0, C_1 \ldots\}$$

Coding of all the scales shall start with, or take as Tonic or Root Chord Tone, any of the declared chord tones. Table 2 shows scales programmed and available to a user of an embodiment of the invention.

TABLE 2

| Scales | |
|---|---|
| Major | Lydian #5 |
| Natural Minor | Lydian b7 |
| Harmonic Minor | Mixolydian b6 |
| Melodic Minor | Locrian #2 |
| Ionic | Whole tones Diminished |
| Doric | Locrian #6 |
| Phrygian | Ionic #5 |
| Lydian | Doric #4 |
| Mixolydian | Phrygian Dominant |
| Aeolian | Lydian #2 |
| Locrian | Locrian b4 bb7 |
| Major Pentatonic | Blues |
| Minor Pentatonic | Dominant Bebop |
| Diminished (t-s) | Major Bebop |
| Diminished (s-t) | Doric Bebop |
| Whole steps | Melodic Minor Bebop |
| Phrygian #6 | |

Coding Function

Now the coding function is defined as:

$$Fint((I,n_s),\text{index})=N_{midi}((n_{oindex})o_{index})+s$$

$$Fint((I,n_s),\text{index})=(\text{index div } m)*12+I_v[\text{index mod } m]+s$$

For example, take G Major Scale which includes G, A, B, C, D, E and F♭ chord tones and in which its initial Chord Tone—root or tonic—is $n_s=G=n_7$. Thus, the basic data of the scale are:

$$I=\{0,2,4,5,7,9,11\}m=7$$

$$n_s=n_7$$

$$I_v=[0,2,4,5,7,9,11]$$

Now MIDI value, corresponding to the index=10 position is calculated.

$$o_{index}=\text{index div } m=10 \text{ div } 7=1$$

$$=i_{index}=I_v[10 \bmod 7]=I_v[3]=5$$

Then, $$Fint((I,n_s),\text{index})=o_{index}*12+i_{index}+7=1*12+5+7=24$$

In other words, the chord tone placed at 10 position of the G Major Scale is the MIDI value corresponding to 24. Table 3 shows an example of C Harmonic Minor Scale Coding using G chord tone which corresponds to the fourth octave as a root chord tone.

TABLE 3

| Index | 0 | 1 | 2 | 3 | 4 | 5 | 6 | 7 | 8 | 9 | 10 | 11 | 12 | ... |
|---|---|---|---|---|---|---|---|---|---|---|---|---|---|---|
| Chord Tone | $C_{(4)}$ | $D_{(4)}$ | $D\#_{(4)}$ | $F_{(4)}$ | $G_{(4)}$ | $G\#_{(4)}$ | $B_{(4)}$ | $C_{(5)}$ | $D_{(5)}$ | $D\#_{(5)}$ | $F_{(5)}$ | $G_{(5)}$ | $G\#_{(5)}$ | ... |
| MIDI Value | 48 | 50 | 51 | 53 | 55 | 56 | 59 | 60 | 62 | 63 | 65 | 67 | 68 | |

The preferred method also allows playing or interpreting the scales already coded and identified in Table 2 or, all those scales the user shall create and which are not included in Table 2.

The function allowing such functionality is described as follows:

let "index" be the position (starting from 0) of a chord tone within a given scale $$E_x=(I,n_s)$$

in the case of the F Major Scale, for instance, index=3 should correspond to $B^{\flat}_0$.

Now a function establishing the relationship between such index and a chord tone or MIDI value is needed.

Let "$I_v$" be the vector with the values of the "I" set of an "m" length, given the "index" and assuming a $E_x=(I, n_s)$, scale, first the "o" and "e" values of the chord tone are determined without considering the tonic or root of the scale:

$$o_{index}=\text{index div } n;$$

$$i_{index}=I_v[\text{index mod } n]$$

Now to obtain the MIDI value of any chord tone $(n_i)_o$ the following formula applied:

$$N_{midi}((n_i)_o)=o*12+i$$

As an example, the algorithmic management module 160 allows setting and manually operating the controls:

| | |
|---|---|
| Tonic Selection | Number of Scales |
| Octave Selection | Types of Scales |
| Scale Editor | Scales Recorder |
| Scale Charger | Rhythmic of Chord Tones and Arpeggios |

Such setting data controlled by the user or interpreter from the input module 110 and which are managed from the processing and storing unit 150 shall affect the Output MIDI module 190 having control at will over the settings, management and full modification of all the one hundred twenty eight (128) controls included in the output MIDI module 190.

The processing and storing unit 150 enables the user or interpreter to save his/her own settings for each module of the invention herein, in a storage media of a digital nature (internal and/or external drivers), enabling them to send such settings to other devices connected through MIDI protocol as well. As an example, this module renders possible to discretionally save and retrieve the scales the user needs during his/her performances and assigned to each press button. Or, it makes possible to save a collection of scales—created or not by the user—to use them during a particular musical performance.

The output unit 180 of the current invention has two modules for such functions as managing and delivering musical data through a MIDI module 190 on the one hand and as displaying visual replies through the Visual Information module 195 by the other.

The first Module of the output unit 180 is the MIDI module 190 which allows a standardized communication between the instrument and any other device for musical creation or managing which supports this communication protocol. The nature of the communication posed by the invention at hand is the MIDI controller, in other words, a relationship MIDI in-out or master-slave.

The output unit 180 is devoted to reinforce the understanding and utilization processes for the user, trying to render information from all the levels of the system, delivering relevant information from each unit and module, depending on the type of information required. This information is displayed by the Visual Information module 195, and in the case of a preferred embodiment, this module is the touch screen 240 which is a part of the input unit and of the output unit.

FIG. 3 shows a schematic representation of the layout of the physical components of the user interface of a preferred embodiment of the invention. The interface has an input unit 230 equipped with an assortment of press buttons. The performance functions of these press buttons may be modified by setting the values and parameters established from the virtual module for custom and musical performance 130. A visual interface 240 (e.g., touch screen) allows a user/performer to both display performance feedback and enter configuration parameters into the device. Linear variable resistances, sliding potentiometer-type (e.g., components 250 and 255), and round rotary potentiometer-type 260 provide linear variable resistances allow a user to dynamically control the output unit 180.

In a preferred embodiment, the virtual input module, for example through touch screen 240, provides the means for configuring the settings of the algorithmic management module 160 for controlling the tempered musical scale, the settings of the virtual module 130 for controlling tonal, timbristic and custom musical performance, the settings of the timbristic musical management and performance module 140 of input unit 110, the settings for the processing and storing unit 150, and the settings of the output unit 180. Hence, the visual information module 240 provides a display of information to the user, a prompt information to request user input, means for capturing user input/activity, and a feedback on the information captured from the user.

Figure 4:
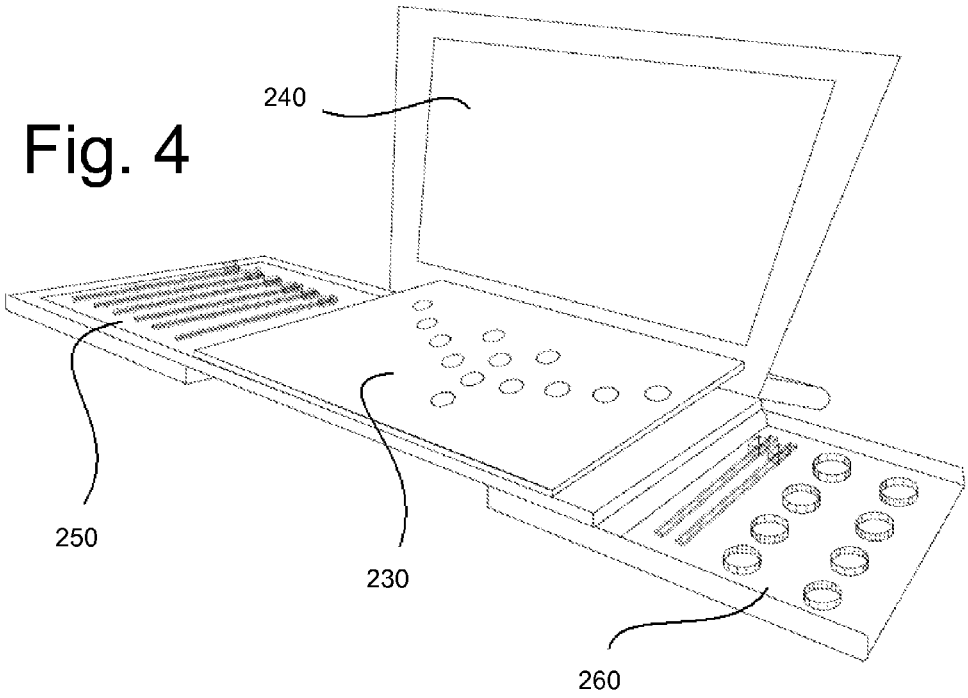
FIG. 4 shows schematic representation of a performance console in accordance with a preferred embodiment.

FIG. 4 shows a schematic representation of a performance console in accordance with a preferred embodiment. The ergonometric arrangement of the various interface components of the performance console provides ease of use during performance.

The invention claimed is:

1. An electronic musical device for digitally managing music interpretation comprising:

an input module comprising an ergonometric console having a plurality of press buttons, wherein each press button of said plurality of press buttons is assigned a musical function for performing at least one tonal sequence, said each press button enabling a hand of a user to enter said at least one tonal sequence by pressing said each button;

a display interaction module comprising a touch screen for allowing said user to enter a plurality of configuration parameters;

a management module comprising a plurality of actuators for enabling said user to enter a dynamic control of timbre of a Musical Instrument Digital Interface (MIDI) protocol data stream by actuating at least one of said plurality of actuators;

a processing and storage module comprising:

a module for coding said at least one tonal sequence over a tempered scale; and a storage media for saving and retrieving said tempered scale as needed during a musical performance; and an output module comprising a MIDI data processing module for applying said configuration parameters and said dynamic control of timbre to said MIDI protocol data stream.

2. The electronic musical device claim 1, wherein said at least one tonal sequence further comprising a function for performing a melody.

3. The electronic musical device claim 1, wherein said at least one tonal sequence further comprising performing an arpeggio.

4. The electronic musical device of claim 1 wherein said plurality of press buttons further comprising:

a central column of press buttons comprising a top press button, a middle press button and a bottom press button;

a top row having two (2) press buttons located in proximity to said top press button, wherein the first of the two press buttons is located on the right side of said top press button and the second press button of the two press buttons is located on the left side of said top press buttons;

a first row of press buttons comprising between three (3) and four (4) press buttons, wherein a first press button of said first row is located in proximity to said middle press button of said central column of press buttons, and wherein said first row is located on the right side of said central column, wherein said first row is generally perpendicular to said central column; and a second row of press buttons comprising between three (3) and four (4) press buttons, wherein a first press button of said second row is located in proximity to said middle press button of said central column of press buttons, and wherein said second row is located on the left side of said central column, wherein said second row is generally perpendicular to said central column.

5. The electronic musical device of claim 4 comprising:

said first row of press buttons, wherein said first press button of said first row is further assigned a first musical function for playing a succeeding interval of a chord tone in said MIDI data stream, further comprising:

a second press button of said first row assigned a second musical function for playing a third root chord tone interval of a selected musical scale in said MIDI data stream;

a third press button of said first row assigned a third musical function for playing a fifth root chord tone interval of said selected musical scale in said MIDI data stream;

said second row of press buttons, wherein said first press button of said second row is further assigned a fourth musical function for playing a preceding interval of a chord tone in said MIDI data stream, further comprising:

a second press button of said second row assigned a fifth musical function for playing a third root chord tone interval in a preceding octave of said selected musical scale in said MIDI data stream; and a third press button of said second row assigned a sixth musical function for playing a fifth root chord tone interval in a preceding octave of said selected musical scale in said MIDI data stream.

6. The electronic musical device of claim 5 comprising:

said first row of press buttons further comprising a fourth press button of said first row assigned a seventh musical function for playing a twelfth root chord tone interval of said selected musical scale in said in said MIDI data stream; and said second row of press buttons further comprising a fourth press button of said second row assigned an eighth musical function for playing a twelfth root chord tone interval in a preceding octave of a selected musical scale in said MIDI data stream.

7. The electronic musical device of claim 6, wherein said first and fourth musical functions produce a tone relative to a most recently played chord.

8. The electronic musical device of claim 6, wherein said second, third and seventh musical functions produce a tone relative to the root chord of said selected musical scale in the octave most recently played, and wherein said fifth, sixth and eighth musical functions produce a tone relative to the root chord of said selected musical scale in the octave preceding said most recently played octave.

9. The electronic musical device of claim 4 further comprising:

said first press button of said top row assigned a musical function for ascending a sequence of chord tones of a scale without playing said chord tones tonally; and said second press button of said top row assigned a musical function for descending said sequence of chord tones of said scale without playing said chord tones tonally.

10. The electronic musical device of claim 4 wherein said middle button of said central column is assigned a musical function for repeating a last chord tone played.

11. The electronic musical device of claim 1 wherein said touch screen is tilt-able for providing a display of arrangement of the press buttons.

12. The electronic musical device of claim 11 wherein said touch screen further providing configuration of a number of press buttons, a leap of absolute and relative tonal intervals, the spatial arrangement of said press buttons, and a size of individual press button.

13. The electronic musical device of claim 1 wherein the touch screen shows the dynamic controls to actuate on the midi module of the output unit.

14. The electronic musical device of claim 1 wherein the dynamic controls comprising motor-driven sliding potentiometer-type having a linear variable resistance.

15. The electronic musical device of claim 1 wherein the dynamic controls comprising motor-driven rotary potentiometer-type having a linear variable resistance.

16. The electronic musical device of claim 1, wherein said management module further configured to enable said user to set quality parameters and sound features for the sequences and sound or music collections, while controlling timbristic enhancement factors comprising sensitivity, sustain, pitch bend, oscillation, and synthesis.

* * * * *